United States Patent [19]

Demaio et al.

[11] Patent Number: 4,958,577

[45] Date of Patent: Sep. 25, 1990

[54] ROLL-UP LAP TRAY

[76] Inventors: Richard Demaio, 640 E. 14th St.; James Piera, 710 E. 13th St., both of, New York, N.Y. 10009

[21] Appl. No.: 365,683

[22] Filed: Jun. 14, 1989

[51] Int. Cl.[5] ..... A47B 23/00

[52] U.S. Cl. ..... 108/43; 108/67; 108/112

[58] Field of Search ..... 108/43, 67, 68, 112, 108/115, 38; 211/169.1, 169; 297/440

[56] References Cited

U.S. PATENT DOCUMENTS

| | | | |
|---|---|---|---|
| 100,446 | 3/1870 | Reichenbach et al. | 108/67 |
| 154,126 | 8/1874 | Cotton | 108/43 |
| 704,552 | 7/1902 | Lieske | 108/67 |
| 981,114 | 1/1911 | Ridgely | 108/67 |
| 1,126,611 | 1/1915 | Wright | 108/67 |
| 3,884,159 | 5/1975 | Faria | 108/67 X |
| 4,026,219 | 5/1977 | Shupe et al. | 108/67 X |
| 4,088,081 | 5/1978 | D'Arcs | 108/27 |
| 4,234,973 | 11/1980 | Vetter et al. | 108/68 X |

*Primary Examiner*—Jose V. Chen

*Attorney, Agent, or Firm*—Terry M. Gernstein

[57] ABSTRACT

A lap tray is amenable to being rolled up into a cylindrical storable configuration, and to being unrolled into a set-up configuration. The tray includes slats mounted on one side of a layer of flexible material, and a brace assembly located on the other side of the layer of flexible material. The brace assembly includes brace elements connected to the slats by a pivot pin and are in an X-shape when supporting the slats in the set-up configuration. The rolled up tray is carried and stored in a carrying case.

1 Claim, 2 Drawing Sheets

ROLL-UP LAP TRAY

TECHNICAL FIELD OF THE INVENTION

The present invention relates to the general art of trays, and to the particular field of lap trays.

BACKGROUND OF THE INVENTION

In the past several years, people have become quite mobile and often travel via trains, buses, automobiles, airplanes and the like. Still further, in recent times with the advent of the lap top computer, portable telephones, portable FAX machines, and even portable copiers, the mobile person has the option of working while he is traveling, even to the point of conducting day-to-day business and office work while he is traveling.

This ability has provided many advantages, yet has created certain problems. One of these problems is caused because most modes of transportation are not designed to facilitate such elaborate work stations. For example, if any support surface is even available to the traveler, it is likely to be a simple tray that was designed as a food support item, such as a drop-down tray found in airplanes.

While satisfactory for some objectives, and adequate for some work, such trays are simply not adequate for the elaborate work station described above. In fact, these trays may not even be fully satisfactory for a less elaborate work station.

Thus, there is a need for a lap top tray that is capable of supporting a user's work station in a comfortable manner.

While the art contains several proposals for lap trays, these trays are often not large enough to achieve the abovestated objective of providing sufficient space for lap top work, or if they are large enough, they are too bulky to be considered truly portable.

Therefore, there is a need for a lap tray that, not only provides sufficient work space for a user, but which is truly portable in nature.

OBJECTS OF THE INVENTION

It is a main object of the present invention to provide a lap tray that is truly portable yet which can provide a great deal of work area.

It is another object of the present invention to provide a lap tray that is easily stored and transported.

It is another object of the present invention to provide a lap tray that is collapsible.

SUMMARY OF THE INVENTION

These, and other, objects are achieved by a lap tray that can be rolled up for storage, yet is stable in use. The lap tray includes a plurality of slats mounted on one side of a layer of flexible material, with a collapsible brace assembly mounted on the other side of the flexible material. The tray is stored by collapsing the brace assembly, rolling up the slats and placing the rolled up tray into a carrying case.

The brace assembly includes means for securing the brace elements to the slats so that once the tray is set up, it will be stable.

DESCRIPTION OF THE DRAWING FIGURES

DETAILED DESCRIPTION OF THE PREFERRED EMBODIMENT OF THE INVENTION

Figure 1:
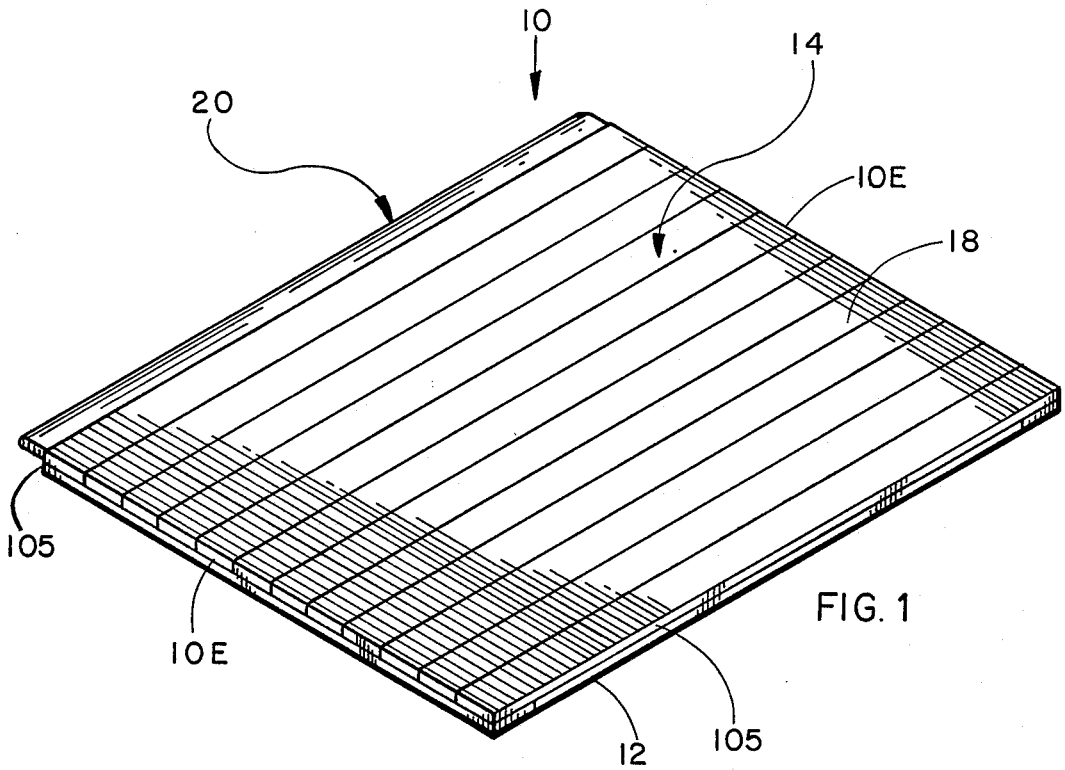
FIG. 1 is a top perspective view of a roll up lap tray embodying the present invention in the set-up configuration.
Figure 2:
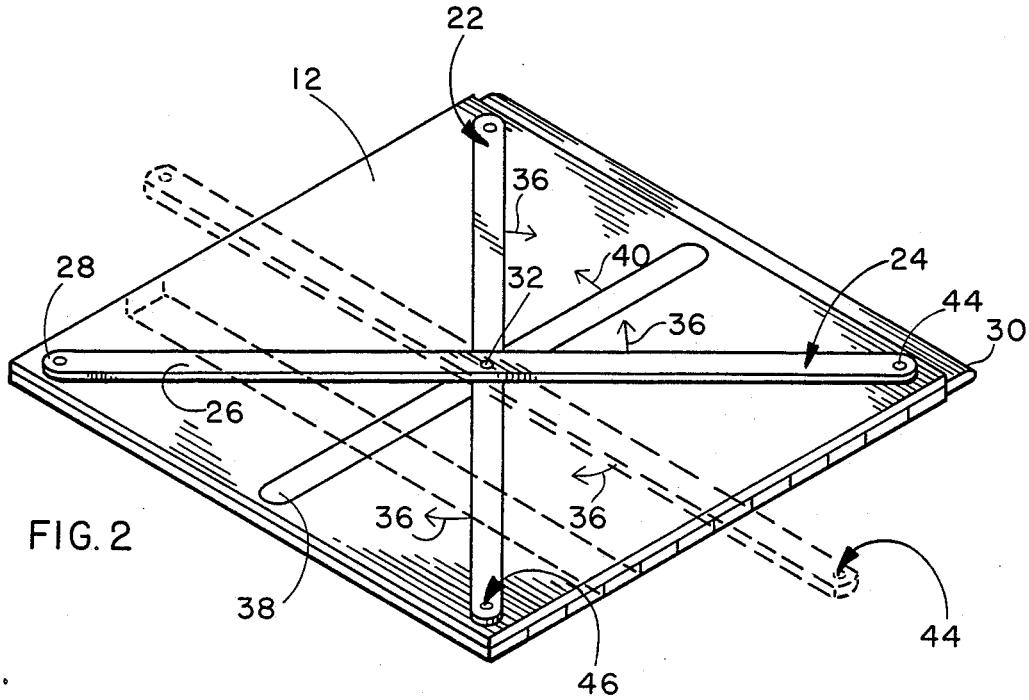
FIG. 2 is a bottom perspective view of the roll up lap tray in the set-up configuration.

Shown in FIGS. 1 and 2 is a roll up lap tray 10 that will provide a work supporting surface having a great deal of work area, yet will be easily transported. The tray preferably has a rectangular shape that is bounded by ends 10E and by sides 10S.

The tray 10 includes a layer of flexible material 12, such as plastics-type material, or the like, which has a first surface and a second surface and which is sandwiched between a work supporting layer 14 and a supporting assembly 16.

The work supporting layer 14 includes a multiplicity of separate slats, such as slat 18. The slats are each plastic and thus transversely flexible and yet are strong enough to securely support a user's work station. The slats can be covered with material such as vinyl or the like, if suitable, and can be of any color. Each slat is independently movable with respect to adjacent slats within the constraints of the flexible material to which all slats are attached for a purpose as will be apparent from the ensuing discussion.

A forward lip 20 is attached to one of the slats and extends along one of the sides 10S upwards above the plane of the work surface formed by the slats to prevent pencils and the like from falling off of that work surface.

The brace assembly 16 includes two brace elements 22 and 24. The brace elements 22 and 24 are identical, and each brace element includes an elongate body 26 having ends 28 and 30 that are rounded and which have an axial length as measured between the two ends that is essentially equal to the diagonal dimension of the opened lap tray.

The brace elements 22 and 24 are pivotally attached to the work supporting layer by a pivot pin 32 that is anchored in one of the slats and which extends through the flexible layer. The brace elements 22 and 24 are attached to the pivot pin 32 near the middle of each brace element and pivot about that pin in the directions indicated in FIG. 2 by arrows 36 to assume the deployed configuration shown in solid lines in FIG. 2 and to assume the stored configuration shown in dotted lines in FIG. 2.

The brace assembly can also include a third brace element 38 that is also pivotally attached to the pivot pin to move as indicated by arrow 40 The third brace element is sized to have a length dimension essentially equal to the width dimension of the set up tray and is used to further support that tray in the set up configuration. The third brace element extends across the width dimension of the tray transversely of the slats 18 to achieve this additional support and is alignable with the brace elements 22 and 24 along the length dimension of the tray in the stored configuration by rotating all of the brace elements into a layered configuration in the direction shown in dotted lines in FIG. 2. The brace elements are preferably plastics-type material, but can be other suitable materials.

Figure 3:
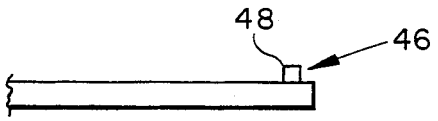
FIG. 3 is an elevational view of a snap for use in releasably attaching a brace unit of the roll up lap tray to slats of that tray.

Each of the brace elements 22 and 24 has a fastener-receiving chamber, such as chamber 44 defined therein adjacent to each end thereof. A fastener, such as fastener 46, (see FIG. 3) is located near each corner of the tray, and includes a projection 48 mounted on a slat and extending through the flexible layer. The brace elements 22 and 24 are attached to the fasteners by flexing those brace elements and fitting the projections 48 into the chambers 44.

Figure 4:
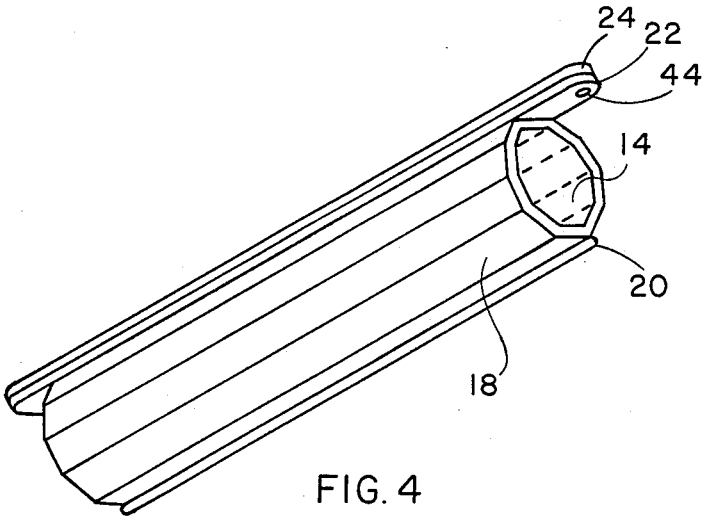
FIG. 4 is a perspective view of the roll up lap tray in the rolled up configuration.

The tray 10 is stored and transported in a rolled up configuration as shown in FIG. 4. The flexible nature of the layer 12 permits that layer to stretch and flex sufficiently to permit the slats to assume the cylindrical configuration shown in FIG. 4. The independent nature of the slats permits the slats to move with respect to each other to move into the FIG. 4 configuration from the FIG. 1 configuration. The third slat 38 is not seen in FIG. 4 since this slat is optional, and even if included, will not extend beyond the edge of the rolled up tray as will the two slats 22 and 24 due to the lengths of such slats vis a vis the length of the tray. The flexible layer 14 is on the inside of the FIG. 4 cylinder.

Figure 5:
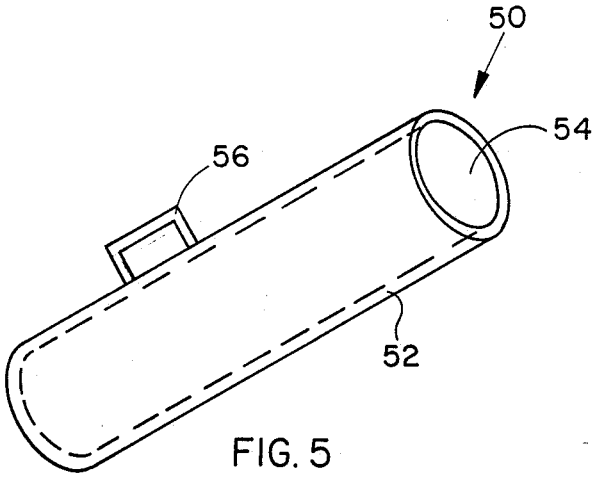
FIG. 5 is a perspective view of a carrying case for storing the roll up lap tray of the present invention.

The rolled up tray is carried in a container 50 best shown in FIG. 5. The container 50 includes a hollow, cylindrical body 52 having a blind-ended bore 54 defined therein and a handle 56 on the body for carrying the container and the rolled up tray.

It is understood that while certain forms of the present invention have been illustrated and described herein, it is not to be limited to the specific forms or arrangements of parts described and shown.

We claim:

1. A roll-up lap tray comprising:

(A) a layer of flexible material having a first surface and a second surface, said layer of flexible material being rectangular in peripheral shape and having ends and sides with said ends intersecting said sides to form corners of said rectangular shape, said flexible material having a length dimension as measured between said ends and a width dimension as measured between said sides with said length dimension being greater than said width dimension, said flexible material further including a diagonal dimension as measured between opposite corners across the center of said rectangular shape;

(B) a plurality of slats mounted on said flexible material first surface, all of said slats extending lengthwise of said flexible material and each slat having a length that is essentially equal to said flexible material length dimension, all of said slats being independent of each other so that said flexible material can be rolled into a cylindrical shape.

(C) a pivot pin connected to one of said slats and extending through said layer of flexible material at the center thereof;

(D) a brace assembly connected to said pivot pin and being located adjacent to said flexible material second surface and including (1) two brace elements, each brace element including ends and each brace element being pivotally connected to said pivot pin intermediate to said ends, and each brace element having a length dimension as measured between said brace element ends which is just slightly less than said diagonal dimension and longer than said length of said flexible material, each brace element further including a snap-receiving chamber defined near each end, one of said brace elements being located immediately adjacent to said layer of flexible material and being located between said layer of flexible material and the other brace element.

(2) snap elements on selected ones of said slats and which extend through said flexible material and being located adjacent to each said corner so that said brace elements form an X-shape with said brace elements extending transversely across said slats when said snap elements are received in said snap-receiving chambers, (3) a third brace element which includes ends and which is pivotally connected to said pivot pin intermediate to the ends of said third brace element, said third brace element having a length dimension as measured between the ends of said third brace element which is essentially equal to said flexible material width dimension, and (4) a lip element attached to one of said slats and extending along one side edge of said flexible material for essentially the entire length of said flexible material; and (E) a carrying container which includes a hollow, cylindrical body having a blind-ended bore defined therein and a handle on said cylindrical body.

* * * * *